US005592795A

United States Patent [19]

Rinehart et al.

[11] Patent Number: 5,592,795

[45] Date of Patent: Jan. 14, 1997

[54] COEXTRUDED POLYMER PRESSURE PLATE

[75] Inventors: David M. Rinehart, Lawrenceville; Wayne E. Whitmyer, Lilburn; Gregory B. McKenna, Cumming, all of Ga.

[73] Assignee: Kawneer Company, Inc., Norcross, Ga.

[21] Appl. No.: 516,123

[22] Filed: Aug. 17, 1995

Related U.S. Application Data

[63] Continuation-in-part of Ser. No. 174,834, Dec. 29, 1993, abandoned.

[51] Int. Cl.[6] ..... E04H 1/00

[52] U.S. Cl. ..... 52/235; 52/204.591; 52/204.595

[58] Field of Search ..... 52/235, 459, 465, 52/461, 463, 464, 467, 466, 469, 395, 204.591, 204.595

[56] References Cited

U.S. PATENT DOCUMENTS

| | | | |
|---|---|---|---|
| 3,734,550 | 5/1973 | Vance | 52/235 X |
| 5,245,808 | 9/1993 | Grunewald et al. | 52/235 |

FOREIGN PATENT DOCUMENTS

| | | | |
|---|---|---|---|
| 2133449 | 7/1984 | United Kingdom | 52/235 |

OTHER PUBLICATIONS

Kawneer Architectural Detail Manual – Wall Systems Section, "1600 Wall" Feb. 1985 (latest update), pp. F1–Index through F1–15.

P. 195 American Heritage Dictionary – "Bon".

*Primary Examiner*—Creighton Smith
*Attorney, Agent, or Firm*—Jones & Askew

[57] ABSTRACT

An improved pressure plate for glazed panel wall construction is disclosed for retaining a glazing panel in place against a corresponding frame member. A gasket element is bonded to the pressure plate and confronts an exterior marginal portion of the glazing panel to retain the glazing panel in place against the frame member. In the disclosed embodiment, the gasket element is comprised of an elastomeric material which is formed integrally with, and preferably coextruded with, the pressure plate. Also in the disclosed embodiment a compression seal bonded to the pressure plate is interposed between the pressure plate and the frame member to thermally isolate the pressure plate from the frame member and to provide a watertight seal. Again, the compression seal of the disclosed embodiment is formed integrally with, and preferably coextruded with, the pressure plate.

20 Claims, 2 Drawing Sheets

COEXTRUDED POLYMER PRESSURE PLATE

This is a continuation-in-part of application Ser. No. 08/174,834, filed Dec. 29, 1993, now abandoned.

TECHNICAL FIELD

The present invention relates generally to glazed panel wall constructions, such as curtain walls, storefronts, and the like. More specifically, the present invention relates to a pressure plate for retaining glazing panels in place against a corresponding frame member and having integral gasket members for weathersealing the joint.

BACKGROUND OF THE INVENTION

It is well known to provide glazing systems for curtain walls, storefront framing systems, and the like wherein the glazing system comprises a frame member and a cooperating pressure plate for retaining glazing panels in place against the frame member. A typical prior art glazing system of this type comprises an extruded aluminum pressure plate fastened to the outer face of the frame member by screws. A pair of gaskets is mounted to the pressure plate within raceways formed on the outer edges of the pressure plate. In turn the gaskets bear against marginal portions of the outer surface of the glazing panel. Where it is desired to provide a thermally insulated glazing system, a thermal separator is interposed between the aluminum pressure plate and the associated frame member.

This type of glazing system suffers a disadvantage in that it is labor-intensive to install. Four separate components—the pressure plate, two gaskets, and the thermal separator—must be installed to each frame member. In addition, the multiplicity of parts requires greater inventory and increases the likelihood of improper installation by inexperienced or unskilled workers. Thus there is a need for a thermally insulated glazing system which reduces the number of parts which must be installed.

A further difficulty inherent in prior art pressure plate designs arises from the fact that the gaskets are often stretched during installation onto the pressure plate. Over time the gaskets tend to return to their original state and thus shrink relative to the pressure plate. This shrinkage can compromise the integrity of the weatherproofing and permit water to penetrate the joint. Thus there is a need for a thermally insulated glazing system which eliminates relative movement between the gaskets and the pressure plate.

SUMMARY OF THE INVENTION

As will be seen, the present invention overcomes these and other problems associated with prior art glazing systems. Stated generally, the present invention provides a thermally insulated glazing system which requires only one component which must be mounted to the frame member to secure the glazing panels, in place of the four components employed in prior art glazing systems. By reducing the number of components which must be installed, labor costs for erecting the glazing system are reduced, the inventory of parts which must be maintained is reduced, and the possibility of improper installation is minimized. Further, the present invention provides a thermally insulated glazing system which substantially eliminates relative movement between the gaskets and the pressure plate, thereby enhancing the weather resistance of the joint.

Stated somewhat more specifically, the present invention relates to a glazed panel wall construction comprising a frame member and a glazing panel disposed adjacent the frame member. A pressure plate is mounted to the frame member. A gasket element is bonded to the pressure plate and confronts an exterior marginal portion of the glazing panel to retain the glazing panel in place against the frame member. In the disclosed embodiment, the gasket element is comprised of an elastomeric material which is formed integrally with, and preferably coextruded with, the pressure plate. Also in the disclosed embodiment, a compression seal bonded to the pressure plate is interposed between the pressure plate and the frame member to thermally isolate the pressure plate from the frame member as well as to provide a compressible, weathertight seal between the pressure plate and the frame member. Again, the compression seal of the disclosed embodiment is formed integrally with, and preferably coextruded with, the pressure plate.

Thus it is an object of the present invention to provide an improved apparatus and method for erecting glazed panel wall constructions such as curtain walls, storefronts, and the like.

It is a further object of the present invention to provide a thermally insulated glazing system which reduces the number of parts which must be installed.

Another object of the present invention is to provide a thermally insulated glazing system which eliminates relative movement between the gaskets and the pressure plate.

Still another object of the present invention is to provide a glazing system with improved thermal insulating characteristics.

Other objects, features, and advantages of the present invention will become apparent upon reading the following specification, when taken in conjunction with the drawings and the appended claims.

DETAILED DESCRIPTION OF THE DISCLOSED EMBODIMENT

Figure 1:
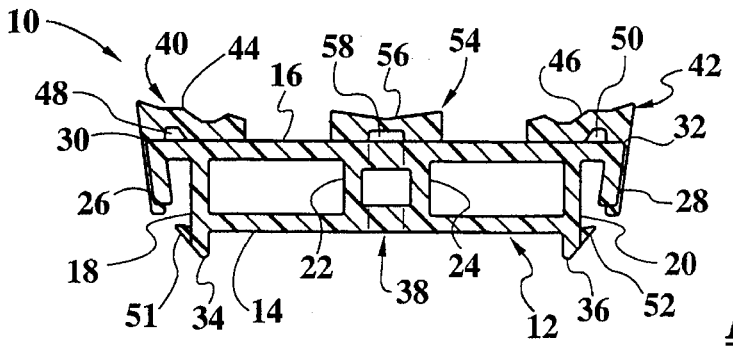
FIG. 1 is an end view of a coextruded pressure plate according to the present invention.

Referring now in more detail to the drawings, in which like numerals indicate like elements throughout the several views, FIG. 1 shows a coextruded pressure plate 10 according to a first embodiment of the present invention. The pressure plate 10 includes a generally box-shaped structural element 12. The structural element 12 is an elongated extrusion of indeterminate length and, in the disclosed embodiment, is comprised of a thermoplastic, e.g. a glass-reinforced polyvinyl chloride composition marketed by B.F. Goodrich under the designation Fiberloc, or a mineral-filled polyvinyl chloride composition such as Tuf marketed by Georgia Gulf. The structural element 12 comprises a front wall 14, a back wall 16, and opposed left and right lateral walls 18, 20. A pair of interior bracing members 22, 24 extend between the front and back faces 14, 16 and are disposed essentially parallel to the side walls 18, 20. The back wall 16 extends outwardly of the two side members 18, 20 and includes forward projecting flanges 26, 28 formed at its outer edges 30, 32. The flanges 26, 28 comprise lateral surfaces of the structural member 12. The side walls 18, 20 extend a short distance forward of the front wall 14 to form a pair of ribs 34, 36 projecting forward from either end of the front wall 14.

A plurality of holes 38 are formed through the front and back walls 14, 16 of the structural element 12 between the interior bracing members 22, 24. The holes 38 are longitudinally spaced apart along the length of the structural element 12 at three inch intervals. The diameter of the holes 38 is sized to receive the threaded shank of a screw for mounting the pressure plate 10 to a frame member, as will be explained below.

Disposed along the outer back edges 30, 32 of the structural element 12 are left and fight glazing gasket members 40, 42 comprised of an elastomeric material such as flexible polyvinyl chloride, DuPont Alcryn, or other suitable elastomer. The gasket members 40, 42 of the disclosed embodiment extend from the front edges of the flanges 26, 28, rearward along the sides of the flanges, around the outer back edges 30, 32, and a short distance inwardly along the back wall 16. The gasket members 40, 42 are continuous along the length of the structural element 12 and are bonded to the structural element, and preferably formed integrally with the structural element such as by coextrusion. The gasket members 40, 42 include rearward facing portions 44, 46 which are somewhat thicker than the remaining portions of the gasket members. Air spaces 48, 50 are provided between the rearward facing portions 44, 46 of the gasket members 40, 42, and the rear wall 16 of the structural element 12 to facilitate compression of the rearward facing portions of the gasket members.

A pair of outwardly and rearwardly projecting ears 51, 52 are formed on the outwardly facing surfaces of the side walls 18, 20. The ears 51, 52 are continuous along the length of the structural element 12 and are bonded to the structural element, and preferably formed integrally with the structural element such as by coextrusion. Preferably the ears 51, 52 are comprised of the same material as the gasket members 40, 42, e.g., flexible polyvinyl chloride or DuPont Alcryn.

A compression seal 54 is disposed along the center of the back wall 16 of the structural element 12. The compression seal 54 of the disclosed embodiment has a concave outer surface 56 and defines an air space 58 between the compression seal and the back wall 16 of the structural element 12. The air space 58 serves two purposes: it facilitates compression of the compression seal, and it provides clearance for a drill point so that penetration of the compression seal does not occur during the manufacturing process when holes are drilled into the pressure plate. The compression seal 54 is continuous along the length of the structural element 12 and is bonded to the structural element, and preferably formed integrally with the structural element such as by coextrusion. Preferably the compression seal 54 is comprised of the same material as the gasket members 40, 42.

The pressure plate 10 is manufactured by conventional coextrusion techniques well known to those skilled in the art and so will be described herein only briefly. A plastic extrusion press apparatus is employed. Pellets of the different substrates, e.g. flexible polyvinyl chloride and glass-reinforced polyvinyl chloride, are placed in separate screw presses, heated, and forced as molten material through separate cavities of the extrusion press apparatus. The different substrates are forced through different ports of an extrusion die and brought together as they exit the die to form a unitary extrusion.

Figure 2:
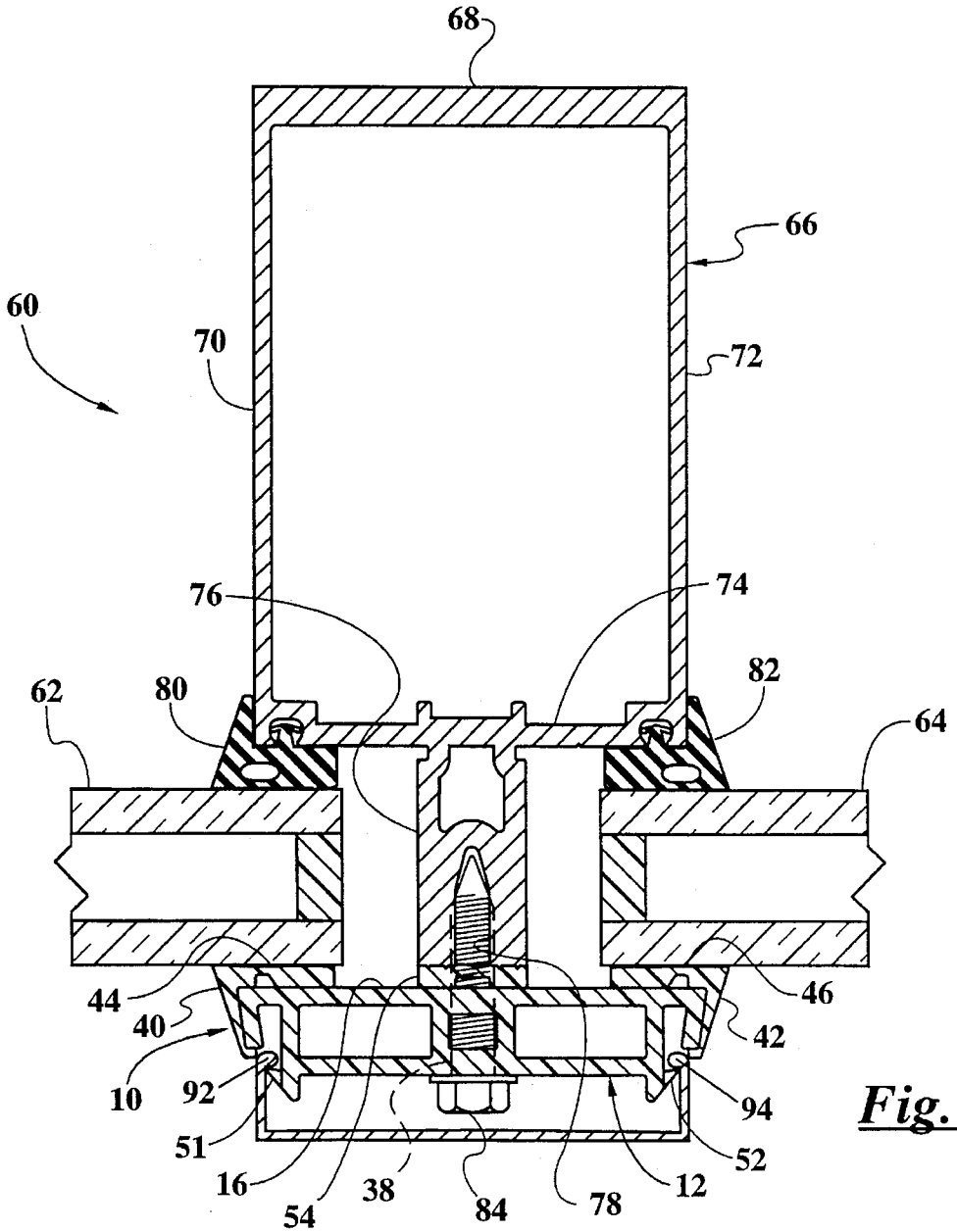
FIG. 2 is an end view of the coextruded pressure plate of FIG. 1 mounted to a frame member.

FIG. 2 depicts the pressure plate 10 mounted to a frame member 60 to retain a pair of glass lites 62, 64 disposed adjacent the frame member. The frame member 60 is of conventional design and is marketed by Kawneer Company, Inc., of Norcross, Ga., USA, under the designation "1600 Wall System." The frame member includes a generally tubular structural section 66 having a rear wall 68, opposed side walls 70, 72, and a front wall 74. A tongue 76 projects forward from the front wall 74 and defines a screw race 78 in its forward edge. Gaskets 80, 82 are mounted to the frame member 10 at the outer edges of the front wall 74 and bear against marginal portions of the interior faces of the corresponding glass lites 62, 64.

The pressure plate 10 is mounted to the frame member 60 by means of screws 84 which pass through the holes 38 in the pressure plate, penetrate the compression seal 54, and extend between the adjacent glass lites 62, 64 to engage the screw race 78 in the forward edge of the tongue 76. While the pressure plate 10 of the disclosed embodiment is provided with holes 38 longitudinally spaced apart at three inch intervals, it will be appreciated that screws 84 are generally required only every nine inches. The additional holes 38 in the pressure plate 10 are provided to ensure that whenever the pressure plate is cut to length, a hole is provided within a short distance of the end of the length. In addition, the three inch spacing will accommodate those situations in which higher loading conditions require screws spaced at six or three inch intervals When the pressure plate 10 is mounted to the frame member 60 in this manner, the rearward facing portions 44, 46 of the gasket members 40, 42 confront exterior marginal portions of the glass lites 62, 64. The gasket members thus form a weathertight seal along the length of the joint between the pressure plate 10 and the glass lites 62, 64.

Further, when the pressure plate 10 is mounted to the frame member 60 in the manner explained above, the compression seal 54 is interposed between the back wall 16 of the structural element 12 and the tongue 76 of the frame member and is compressed against the tongue of the frame member as the screws 84 are tightened. The compression seal 54 performs two separate functions. First the compression seal forms a continuous, air- and water-tight seal between the pressure plate 10 and the frame member 60 which prevents air and water which might penetrate between the glass lites 62, 64 from passing through the joint. This feature is especially important when the frame member 60 is disposed horizontally, as it prevents water which may seep past the gaskets from leaking into the interior of the building. Second the compression seal 54 thermally isolates the pressure plate 10 from the frame member 60. In the disclosed embodiment of the pressure plate 10, this latter function is of less importance, because the structural element 12 is itself formed of a thermally nonconductive material.

After the pressure plate 10 has been mounted to the frame member 60, a cover 90 is mounted to the pressure plate. The cover 90 is generally U-shaped and includes inwardly projecting fingers 92, 94 formed at its rearward ends. The fingers 92, 94 snap behind the ears 51, 52 on the outwardly facing surfaces of the side walls 18, 20 of the structural element 12 to retain the cover member 90 in place against the pressure plate 10. The cover is primarily decorative in nature and can be comprised of any suitable material, including aluminum or plastic.

Figure 3:
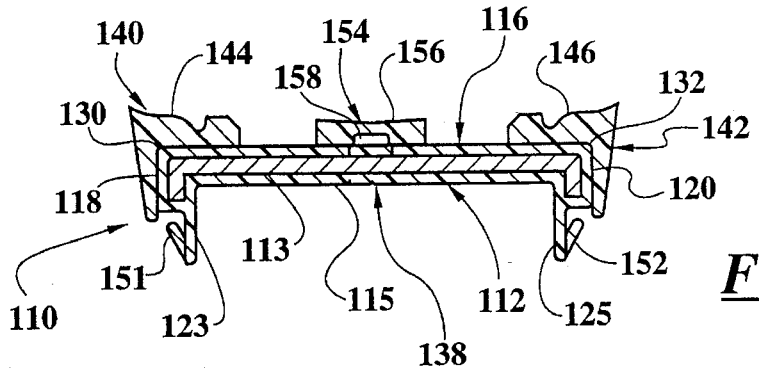
FIG. 3 is an end view of an alternate embodiment of a coextruded pressure plate according to the present invention.

FIG. 3 shows a coextruded pressure plate 110 according to a second embodiment of the present invention. The pressure plate 110 includes a generally U-shaped structural element 112. The structural element 112 is an elongated extrusion of indeterminate length and comprises a metal core 113 surrounded by an outer jacket 115 of rigid polyvinyl chloride. In the disclosed embodiment, the metal core 113 comprises a roll-formed aluminum channel. The structural element 112 comprises a transverse wall 116 and opposed left and right lateral walls 118, 120. The outer jacket 115 comprises a pair of arms 123,125 projecting forward from the inner surface of the left and right lateral walls 118,120. The transverse wall 116 includes outer back edges 130, 132.

A plurality of holes 138 are formed through the transverse wall 116 of the structural element 112. The holes 138 are longitudinally spaced apart along the length of the structural element 112 at three inch intervals. The diameter of the holes 138 is sized to receive the threaded shank of a screw for mounting the pressure plate 110 to a frame member.

Disposed along the outer back edges 130,132 of the structural element 112 are left and right glazing gasket members 140, 142 comprised of an elastomeric material such as flexible polyvinyl chloride or DuPont Alcryn. The gasket members 140, 142 of the disclosed embodiment extend from the front edges of the lateral walls 118, 120 rearward along the sides of the lateral walls, around the outer back edges 130, 132, and a short distance inwardly along the back face of the transverse wall 116. The gasket members 140, 142 are continuous along the length of the structural element 112 and are bonded to the structural element, and preferably formed integrally with the structural element such as by coextrusion. The gasket members 140, 142 include rearward facing portions 144,146 which are somewhat thicker than the remaining portions of the gasket members.

A pair of outwardly and rearwardly projecting ears 151, 152 are formed on the outwardly facing surfaces of the forwardly projecting arms 123, 125 adjacent their forward ends. The ears 151,152 are continuous along the length of the structural element 112 and are bonded to the structural element, and preferably formed integrally with the structural element such as by coextrusion. Preferably the ears 151,152 are comprised of the same material as the gasket members 140, 142, e.g., flexible polyvinyl chloride or DuPont Alcryn.

A compression seal 154 is disposed along the center of the transverse wall 116 of the structural element 112. The compression seal 154 of the disclosed embodiment has a concave outer surface 156 and defines an air space 158 between the compression seal and the back wall 116 of the structural element 112. The air space 158 serves two purposes: it facilitates compression of the compression seal 154, and it provides clearance for a drill point so that penetration of the compression seal does not occur during the manufacturing process when holes are drilled into the pressure plate. The compression seal 154 is continuous along the length of the structural element 112 and is bonded to the structural element, and preferably formed integrally with the structural element such as by coextrusion.

Like the pressure plate 10 of the first embodiment, the pressure plate 110 is manufactured by conventional coextrusion techniques well known to those skilled in the art and so will be described herein only briefly. Again, a plastic extrusion press apparatus is employed. Pellets of the different substrates, e.g. flexible polyvinyl chloride and rigid polyvinyl chloride, are placed in separate screw presses and forced as molten material through separate cavities of the extrusion press apparatus. The different substrates are forced through different ports of an extrusion die. The metal core 113 is a roll-formed aluminum member which is fed through the die concurrently with the polymeric substrates. The various materials are brought together as they exit the die to form a unitary extrusion.

Figure 4:
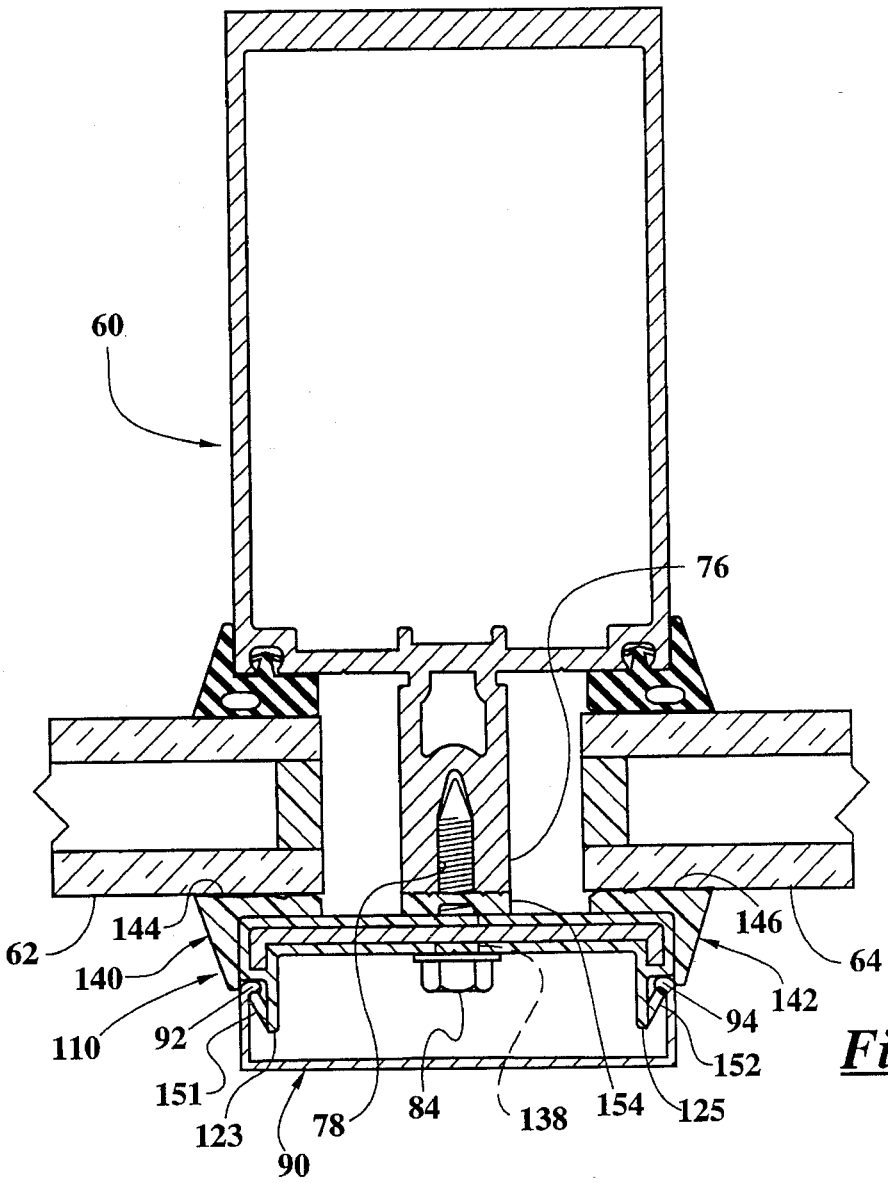
FIG. 4 is an end view of the pressure plate of FIG. 3 mounted to a frame member.

FIG. 4 depicts the pressure plate 110 of the second embodiment mounted to a frame member 60 to retain a pair of glass lites 62, 64 disposed adjacent the frame member. The pressure plate 110 is mounted to the frame member 60 by means of screws 84 which pass through the holes 138 in the pressure plate, penetrate the compression seal 154, and extend between the adjacent glass lites 62, 64 to engage the screw race 78 in the forward edge of the tongue 76. The rearward facing portions 144, 146 of the gasket members 140,142 confront exterior marginal portions of the glass lites 62, 64. The compression seal 154 is interposed between the transverse wall 116 of the structural element 112 and the tongue 76 of the frame member and is compressed against the tongue of the frame member as the screws 84 are tightened. The cover 90 is then mounted to the pressure plate 110 by engaging the inwardly projecting fingers 92, 94 of the cover member with the ears 151,152 on the outwardly facing surfaces of the forwardly projecting arms 123,125.

As is the case with the compression seal 54 of the first embodiment 10, the compression seal 154 of the second embodiment 110 performs two separate functions: providing a continuous, water-tight seal between the pressure plate 110 and the frame member 60, and thermally insulating the pressure plate 110 from the frame member 60. However, unlike the first embodiment, the pressure plate 110 of the second embodiment is not comprised entirely of a thermally nonconductive material. Accordingly, the function of thermally insulating the pressure plate 110 from the frame member 60 assumes greater importance than in the first embodiment.

It will be appreciated that the pressure plates 10, 110 of the disclosed embodiments provide numerous advantages over prior art pressure plates for retaining glass lites in position against corresponding frame members. First, the pressure plate of the present invention is far less labor-intensive to install. Rather than having to install four separate components—the pressure plate, two gaskets, and the thermal separator—to each frame member, only a single component need be installed. This feature reduces the multiplicity of parts, resulting in reduced inventory, and decreases the likelihood of improper installation by inexperienced or unskilled workers. Also, because the gaskets are bonded directly to the structural element—and in fact formed integrally with the structural element by coextrusion in the disclosed embodiments—problems associated with gaskets being stretched during installation onto the pressure plate, such as the tendency of gaskets later to return to their original state and thus shrink relative to the pressure plate, are eliminated. Further, the problems of gaskets becoming dislodged from the pressure plate are also eliminated. Also, due to the low thermal conductivity of the materials used, the pressure plates 10, 110 exhibit increased thermal performance over the standard all-aluminum pressure plate.

Finally, it will be understood that the preferred embodiment has been disclosed by way of example, and that other modifications may occur to those skilled in the art without departing from the scope and spirit of the appended claims.

What is claimed is:

1. A glazed panel wall construction comprising:

a frame member;

a glazing panel disposed adjacent said frame member;

a pressure plate mounted to said frame member; and a gasket element bonded to said pressure plate and confronting an exterior marginal portion of said glazing panel.

2. The glazed panel wall construction of claim 1, wherein said gasket element bonded to said pressure plate comprises a gasket element formed integrally with said pressure plate.

3. The glazed panel wall construction of claim 2, wherein said gasket element formed integrally with said pressure plate comprises a gasket element coextruded with said pressure plate.

4. The glazed panel wall construction of claim 1, wherein said pressure plate further comprises a compression seal bonded to said pressure plate and interposed between said pressure plate and said frame member, whereby said frame member is thermally insulated from said pressure plate.

5. The glazed panel wall construction of claim 4, wherein said compression seal bonded to said pressure plate comprises a compression seal formed integrally with said pressure plate.

6. The glazed panel wall construction of claim 5, wherein said compression seal formed integrally with said pressure plate comprises a compression seal coextruded with said pressure plate.

7. The glazed panel wall construction of claim 1, wherein said pressure plate is comprised of a polymeric material.

8. The glazed panel wall construction of claim 1, wherein said pressure plate is comprised of a metal frame member coated with a jacket of a polymeric material, said polymeric jacket providing a surface to which said gasket elements can be bonded.

9. The glazed panel wall construction of claim 1, wherein said gasket element is comprised of an elastomeric material.

10. The glazed panel wall construction of claim 4, wherein said compression seal is comprised of an elastomeric material.

11. The glazed panel wall construction of claim 4, wherein said compression seal and said gasket element are comprised of an elastomeric material.

12. The glazed panel wall construction of claim 1, further comprising:

a cover member; and ears bonded to said pressure plate, said ears being comprised of a material different from said pressure plate, said cover member engaging said ears for retaining said cover member on said pressure plate.

13. The glazed panel wall construction of claim 12, wherein said ears bonded to said pressure plate comprise ears formed integrally with said pressure plate.

14. The glazed panel wall construction of claim 13, wherein said ears formed integrally with said pressure plate comprise ears coextruded with said pressure plate.

15. A pressure plate system for retaining glazing panels in place against a frame member, comprising:

a structural member comprised of a polymer, said structural member defining a hole therethrough;

a gasket element bonded to said structural member and disposed such that when said pressure plate is mounted to a frame member having a glazing panel associated therewith, said gasket element confronts an exterior marginal portion of said glazing panel to retain said glazing panel in place against said frame member; and a fastener dimensioned to be received through said hole in said structural member for securing said pressure plate to a frame member and for tightening said pressure plate toward said frame member.

16. The pressure plate system of claim 15, wherein said gasket element bonded to said structural member comprises a gasket element formed integrally with said structural member.

17. The pressure plate system of claim 16, wherein said gasket element formed integrally with said structural member comprises a gasket element coextruded with said structural member.

18. The pressure plate system of claim 15, further comprising a compression seal bonded to said structural member and disposed such that when said pressure plate is mounted to said frame member, said compression seal is interposed between said frame member and said structural member so as to form a weather-resistant seal between said frame member and said structural member.

19. The pressure plate system of claim 18, wherein said compression seal bonded to said structural member comprises a compression seal formed integrally with said structural member.

20. The pressure plate of system claim 19, wherein said compression seal formed integrally with said structural member comprises a compression seal coextruded with said structural member.

* * * * *